US005904805A

United States Patent [19]

Marchetti

[11] Patent Number: 5,904,805

[45] Date of Patent: May 18, 1999

[54] GUMMED PAPER TAPING UNIT WITH IMPROVED GUIDANCE OF THE PAPER IN THE DAMPENING ZONE

[76] Inventor: Augusto Marchetti, Piazza Sicilia, 7-20146 Milan, Italy

[21] Appl. No.: 08/871,908

[22] Filed: Jun. 12, 1997

[30] Foreign Application Priority Data

Jun. 13, 1996 [IT] Italy ..... MI960434 U

[51] Int. Cl.[6] ..... B32B 31/00

[52] U.S. Cl. ..... 156/575; 156/577; 156/578; 118/264

[58] Field of Search ..... 156/574, 575, 156/577, 578, 442, 442.2; 118/264

[56] References Cited

U.S. PATENT DOCUMENTS

| | | | |
|---|---|---|---|
| 3,014,454 | 12/1961 | Smejda | 118/264 X |
| 4,380,210 | 4/1983 | Auerbach | 118/264 X |
| 5,478,430 | 12/1995 | Marchetti | 156/578 X |

FOREIGN PATENT DOCUMENTS

| | | | |
|---|---|---|---|
| 0 558 122 | 9/1993 | European Pat. Off. . | |
| 0 579 329 | 1/1994 | European Pat. Off. . | |
| 306256 | 6/1918 | Germany | 156/578 |

*Primary Examiner*—Mark A. Osele
*Attorney, Agent, or Firm*—Cushman Darby & Cushman IP Group of Pillsbury Madison & Sutro LLP

[57] ABSTRACT

A taping unit for gummed paper includes a support for a reel of gummed paper, a paper feeder, a cutter, a paper deviator, a dampener with moistened bristles placed downstream of the deviator, and an applicator for applying single lengths of gummed paper onto the top or the bottom of a box. The paper deviator includes at least two cooperating guide pads, located one upstream of the other in the direction of the forward movement of the paper. The downstream guide pad defines, in front of the dampener, a resting plane for the paper, in front of which there extend from the upstream guide pad and parallel to the resting plane a large number of vertical wires arranged side by side, that provide guiding of the gummed paper lengths between the resting plane and the bristles of the dampener.

3 Claims, 2 Drawing Sheets

GUMMED PAPER TAPING UNIT WITH IMPROVED GUIDANCE OF THE PAPER IN THE DAMPENING ZONE

BACKGROUND OF THE INVENTION

The present invention deals with a gummed paper taping unit with improved guidance of the paper in the dampening zone.

Gummed paper taping units are used in carton sealing machines for delivering and applying short lengths of paper with moistened gummed faces onto the tops and/or bottoms of boxes.

Known gummed paper taping units, described in EP-A-0558122 and EP-A-0579329, comprise substantially a supporting means for a reel of gummed paper, a feeding means for extracting a continuous strip of gummed paper from the reel and having it move along a predetermined path with an oblique terminal portion, a cutting means situated substantially at the end of the oblique path portion for the purpose of cutting the continuous strip into single lengths of gummed paper, a paper path-deviating means for positioning the paper in a vertical direction at the end of the oblique path portion, a dampening means with moistened bristles set downstream of the deviation means for dampening the gummed paper lengths and a means for applying the gummed paper lengths onto the top or the bottom of a box.

In the taping units the means for deviating the paper is made up of at least two co-operating guide pads which are placed one upstream of the other in the direction of the forward movement of the paper, and define an arcuate path portion for the paper and, downstream thereof and in front of the dampening group, a resting plane for the paper undergoing the dampening treatment.

It has been possible to verify that the solution presently being used is not completely fit for very light gummed paper. As a matter of fact, in this case it can happen that the paper coming out of the upstream guide pad crinkles or is subject to other distortions and hence does not reach the desired correct engagement with the bristles of the dampening means. The taping unit jams up or, at the least, emits deformed paper lengths which are not fit for a correct sealing of the box.

SUMMARY OF THE INVENTION

The purpose of this present invention is to provide a gummed paper taping unit that is able to guarantee a better and more secure guide of the paper in the dampening zone.

In accordance with this invention, the aforementioned purpose has been achieved by way of a gummed paper taping unit of the type described in EP-A-0558122 and EP-A-0579329, characterized in that, in the means for deviating the paper, from the upstream guide pad and parallel to the paper resting plane defined by the downstream guide pad, there extend a plurality of vertical side-by-side arranged wires which provide for guiding the gummed paper lengths between the resting plane and the bristles of the dampening means.

In this way, without any interference with the working of the dampening unit bristles, the guiding of the paper is made to continue even in the dampening zone, thus avoiding any deformation and jamming-up of the paper, which reaches the application means with the right amount of dampening without any mishaps.

BRIEF DESCRIPTION OF THE DRAWINGS

The features of the present invention will be rendered even more evident by the following detailed description of a preferred embodiment of the same, illustrated by a non-limitative example in the following drawings in which.

DETAILED DESCRIPTION

Figure 1:
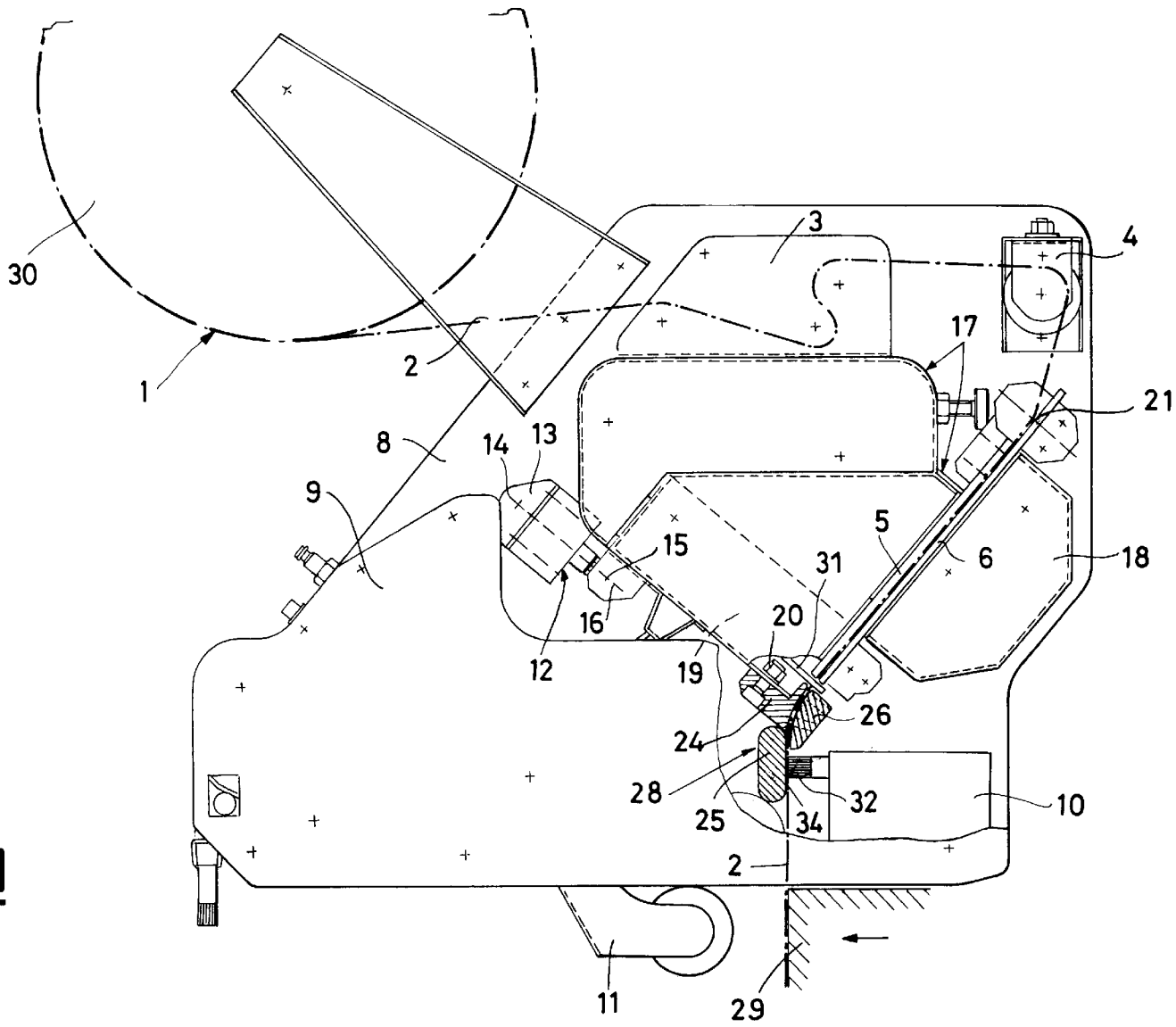
FIG. 1 shows a side view of a taping unit in accordance with the invention.

With reference to FIG. 1, the taping unit in accordance with the invention is essentially comprised of a plurality of operative groups fixed to a lateral support shoulder 8 to which corresponds, on the opposite side, a shorter shoulder 9 for side containment.

More precisely, the taping unit comprises a supporting 1 for a reel 30 of gummed paper 2, a paper controller 3 for controlling the unwinding of the paper 2 from the reel 30, a paper centerer 4, a pair co-operating plates 5 and 6 for the guiding and sliding of the paper, a paper feeder 17 and a co-operating contrast means 18, respectively associated with the two plates 5 and 6 for determining the intermittent forward movement of a continuous strip of paper 2 along a path with an oblique terminal portion, a cutter means 19 with a knife 31 associated with the feeder means 17 for separating paper lengths having pre-established lengths from the continuous strip of paper taken out of the reel 30, a dampener 10 with moistened bristles 32 for the dampening of the glued face of the gummed paper lengths; and an applicator 11 for carrying out the, application of duly moistened gummed paper lengths, onto the boxes to be sealed.

The construction features and the mode of operation of the aforementioned elements, which are of a kind per se known from the aforementioned document EP-A-0558122, will not be herewith described in detail; it is sufficient to point out that the plate 5, together with the feeder 17 and the cutter 19, is rotatable around an axis 21 defined by a fixed pivot on shoulder 8, in such a way as to permit opening of a substantial part of the paper path for the sake of maintenance or for avoiding that, in the event of long pauses and in the presence of humidity, the gummed paper can stick to one of the plates, thus jamming the taping unit.

The rotation of the plate 5 is commanded by a release device 12 made up of a pneumatic cylinder 13 which is pivoted at 14 on the shoulder 8 and has a rod hingedly connected at 15 to a squared piece 16 fixed to the external housing of the feeding means 17.

The transportation of the paper from the pair of plates 5 and 6 to the dampener 10 is carried out by having the paper itself pass through a path deviator 28, composed of three guide pads 24, 25 and 26 that deviate the path of the paper towards a direction that is exactly vertical, for the application of the paper starting from the front end of the box 29 to be sealed.

Guide pad 24 is positioned at the exit end of plate 5, immediately after the cutter means 19, and is rigidly connected to the external structure of the latter by means of a nut and screw 20.

Guide pad 26, instead, is solid with shoulder 8, positioned exactly opposite to guide pad 24, in such a way as to form with it a thin arcuate passage for the paper towards the dampening means 10.

Following the guide pad 24 and immediately downstream of the guide pad 26, there is rigidly connected to the shoulder 8 the guide pad 25, which defines a vertical resting plane 34 for the paper being moistened in front of the bristles 32 of the dampener 10.

Figure 2:
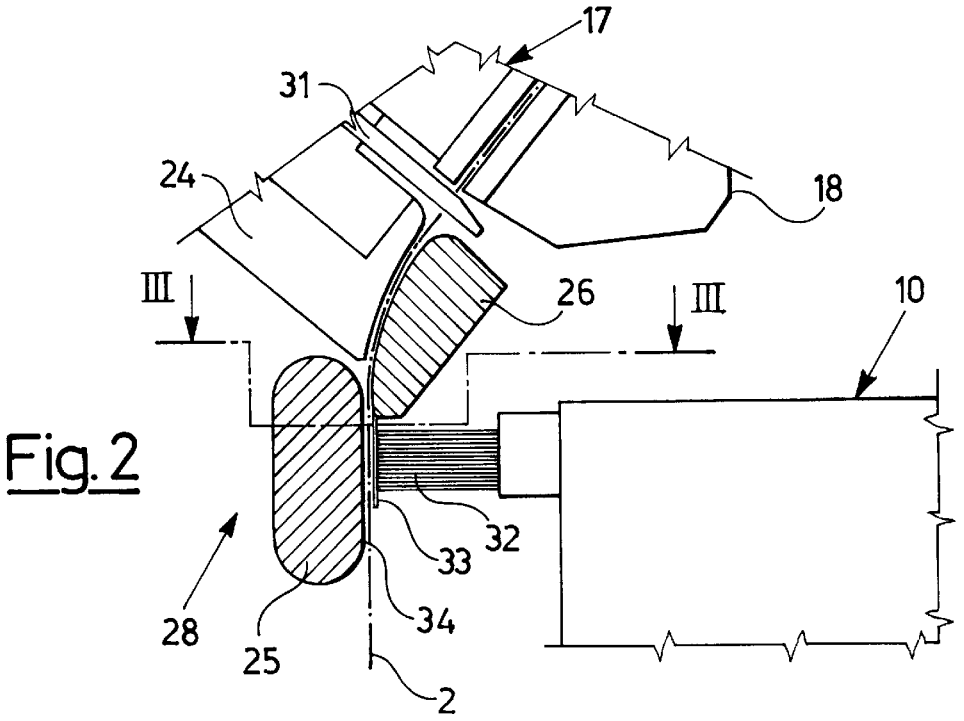
FIG. 2 shows, on an enlarged scale, the paper dampening zone of the same taping unit.
Figure 3:
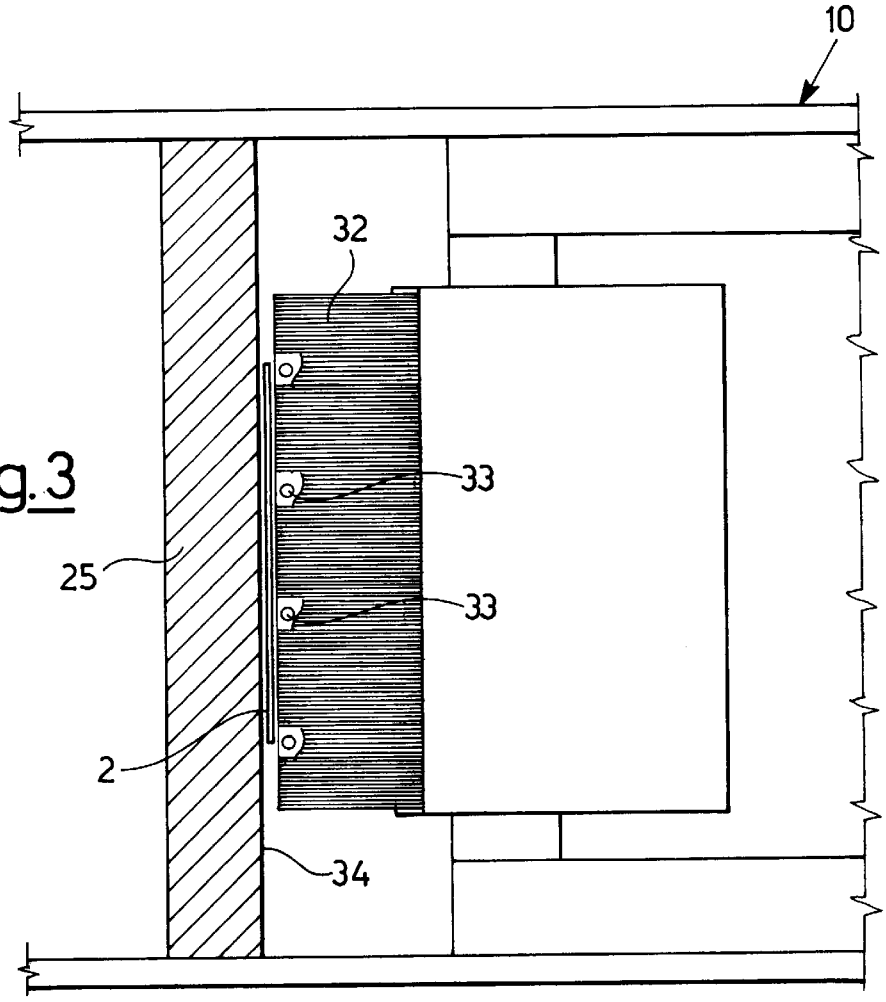
FIG. 3 shows the aforementioned zone in cross-section according to lines III—III of FIG. 2.

As evidenced in FIGS. 2 and 3, from guide pad 24 there extend parallel to from the aforementioned resting plane 34 of guide pad 25 a large number of vertical metal wires 33 placed side by side, which guide the gummed paper lengths between the resting plane 34 and the bristles 32 of the dampening group 10.

In this way, without interfering with the action of the dampening bristles 32, the guiding of the paper is made to continue its way also in the dampening zone, thus preventing deformations and jamming of the paper, which reaches the application means 11 without mishap and with the right amount of dampening.

I claim:

1. A gummed paper taping unit for taping boxes with lengths of moistened paper tape, comprising:

a support for a reel of gummed paper;

a feeder for progressively taking a continuous strip of gummed paper from the reel by unreeling and by advancing a leading end portion of the continuous strip along a predetermined path which includes an oblique terminal portion having an end;

a cutter positioned substantially at said end and arranged for cutting said continuous strip of gummed paper into a succession of individual lengths of gummed paper;

a paper path deviator arranged to act on each of said gummed paper lengths in succession downstream of said cutter, for causing each gummed paper length in succession to undergo a transition from being obliquely oriented, to being vertically oriented so as to advance along a vertical extension of said path;

a dampener arranged to dampen gum provided on said gummed paper lengths while said gummed paper lengths are advancing in succession in a direction along said vertical extension of said path;

an applicator for applying the gummed paper lengths having dampened gum, in succession, onto boxes for taping the boxes;

said deviator comprising:

at least one first guide pad disposed for acting on a respective face of each said length of gummed paper in succession, between said cutter and said dampener, for arcuately transitioning each length of gummed paper from being obliquely oriented to being vertically oriented; and a further guide pad located between said at least one first guide pad and said applicator so as to provide a vertical resting plane for each said length of gummed paper, disposed on an opposite side of said length of gummed paper, disposed on an opposite side of said path extension from said dampener; and a plurality of wires disposed side by side, with spacing between them and arranged to guide each said gummed paper length in succession on a same side of said path extension as said dampener, as each length of gummed paper in succession is having the gum thereon dampened by said dampener acting between said wire; said wires being connected to and extending downward from said first guide pad.

2. The gummed paper taping unit of claim 1, wherein:

said deviator further comprises another said first guide pad cooperating with said one first guide pad by being disposed for acting on an opposite face of each said length of gummed paper in succession, between said cutter and said dampener, for arcuately transitioning each length of gummed paper from being obliquely oriented to being vertically oriented.

3. The gummed paper taping unit of claim 1, wherein:

said dampener comprises bristles arranged for applying moisture to the gum on each said length of gummed paper in succession.

* * * * *